US005769354A

United States Patent [19]

Lindh et al.

[11] Patent Number: 5,769,354

[45] Date of Patent: Jun. 23, 1998

[54] PAPER ROLL CONTAINER ARRANGEMENT

[76] Inventors: Ulf Lindh, Ugglevägen 7, Nacka, Sweden, 131 44; Boris Nauman, Sturegatan 44 B, Stockholm, Sweden, 114 36

[21] Appl. No.: 750,252

[22] PCT Filed: May 9, 1995

[86] PCT No.: PCT/SE95/00512

§ 371 Date: Dec. 5, 1996

§ 102(e) Date: Dec. 5, 1996

[87] PCT Pub. No.: WO95/33401

PCT Pub. Date: Dec. 14, 1995

[30] Foreign Application Priority Data

Jun. 7, 1994 [SE] Sweden ..... 9401962
Jan. 4, 1995 [SE] Sweden ..... 9500024

[51] Int. Cl.[6] ..... A47K 10/22; A47K 10/38

[52] U.S. Cl. ..... 242/593; 242/597.1; 242/497.7

[58] Field of Search ..... 242/593, 597, 242/597.1, 597.4, 597.5, 597.6, 597.7

[56] References Cited

U.S. PATENT DOCUMENTS 3,539,124 11/1970 Belokin, Jr. .
3,627,216 12/1971 Ekuan ..... 242/593
3,863,861 2/1975 Bellasio ..... 242/593
5,141,171 8/1992 Yang ..... 242/593

FOREIGN PATENT DOCUMENTS 2 027 808 12/1971 Germany ..... 242/597.1
9203182 4/1994 Sweden .
WO 81/02880 10/1981 WIPO ..... 242/593

*Primary Examiner*—John P. Darling
*Attorney, Agent, or Firm*—Jacobson, Price, Holman & Stern, PLLC

[57] ABSTRACT

A container arrangement constructed to enable a web of material (35) to be withdrawn from the outer surface of a generally cylindrical roll, preferably a roll of toilet paper or like material. The arrangement includes a roll container (1), which can be opened to enable depleted rolls to be replaced. The container (1) includes a web outfeed opening which is coaxial with the roll axis. Mounted at one end wall of the container (1) is a cylindrical guide member (4) whose circular peripheral edge is aligned coaxially with the axis (10) of the outfeed opening (63) and whose diameter exceeds the effective, initial diameter of an unused roll (3). The guide member (4) functions to deflect the web from the cylindrical surface of the roll as the web (35) is drawn through the opening (63). The guide member (4) is rotatably journalled (51) for rotation about an axis which extends generally coaxial with the roll axis.

20 Claims, 2 Drawing Sheets

PAPER ROLL CONTAINER ARRANGEMENT

BACKGROUND OF THE INVENTION

The invention relates generally to a container arrangement.

More specifically, although not exclusively, the invention relates to a roll container arrangement which includes an openable roll container and which enables a web of material, preferably a paper web, to be pulled from the outside of the roll, preferably a roll of toilet paper.

U.S. Pat. No. 3,539,124 teaches a container arrangement which includes a rotation-svmmetrical basin and a pin located centrally on the bottom of the basin. The pin is intended to receive a roll of toilet paper having a central winding core made of cardboard or like material. Subsequent to placing the roll on the pin, a lid or cover having a centrally located peg is fitted onto the opposite end of the roll (i.e. the opposite end of the cardboard core). An annular gap is formed between the edge of the basin and the edge of the cover. The paper web is drawn off from the outer surface of the roll through said gap. The paper web is drawn from the roll by circulating around the outfeed gap and usually becomes twisted in the process.

SE-A-9203182.2 teaches an arrangement similar to the arrangement just described, although in this case the container basin is intended to be mounted on a wall so that the annular paper web outfeed gap faces downwards, and the paper roll is intended to rotate about a centre pin or peg in the basin. The container arrangement includes an end plate which defines the annular outfeed gap together with the edge of the basin and which is firmly connected to the bottom end of the pin. The circular end plate has a diameter which is greater than the original diameter of the roll, so as to prevent the web from sliding axially on the outer surface of the roll when web material, e.g. paper, is drawn from the container arrangement. This end plate thus has a guiding function and forms a firm seating for the bottom end surface of the roll and can be removed when needing to place a new roll in the roll container.

The arrangement taught by SE-A-9203182.2 has been found to be unusable because the material web tends to break or tear inside the basin. It has not been possible to solve this problem and consequently this known arrangement has not been marketed commercially.

SUMMARY OF THE INVENTION

The object of the present invention is to provide a container arrangement which minimizes the tensile force that acts on a web of material when unrolled from the outside of a roll, particularly a paper roll, such as a toilet paper roll, rotatably mounted in the container, and with which the web is deflected around the edge of a web-deflecting guide member whose effective diameter is greater than the roll diameter, and with which said guide member is located between the roll and the web outfeed opening in the container arrangement.

This object is achieved with an arrangement according the claims.

A central feature of the inventive arrangement is that the guide member is arranged for rotation about an axis which is coaxial with the container. It is thus important to the invention that the actual guide member is able to rotate. The rotational bearings of the guide member may be disposed between the guide member and a roll guide pin, when such a pin is included. Alternatively, the guide member and a possible guide pin may be firmly connected together while the other end of the guide pin is rotatably connected to the container arrangement. The container arrangement will preferably include a guide pin which extends through the central bore of the paper roll and the guide pin will preferably have a diameter which is sufficiently small to enable the roll to rotate on the pin, at least in that case when the rotational bearing of the guide member is located between the pin and the guide member.

As a result of the substantial reduction in tensile forces on the web as the web is pulled from the roll, the container can be configured with a centrally positioned, small outfeed hole in one end wall of the generally cylindrical container, this end wall preferably being profiled to form a gently curved guide surface, particularly in the region adjacent the web outfeed opening. The gap defined between the guide member and said end wall may be made relatively narrow, such that the part of the web that extends through the outfeed opening will be subjected to a given retaining force or holding force. This will prevent the end of the web extending through said opening from falling back into the interior of the container. This enables the container arrangement to be handled freely, for instance allows the arrangement to be placed with its cylindrical surface extending horizontally, or placed on its base with the outfeed opening facing upwards, and, when in use, can also be held in any desired position with one hand while drawing the web through the web outfeed opening.

Assuming that the inventive container arrangement is placed so that the outfeed opening faces upwards and that the material web is withdrawn through said opening, or hole, the tensile force acting in the web will tend to lift the roll from its bottom seating surface, thereby reducing the pressure normally exerted by the roll on the seating surface and therewith also reducing the friction generated as the roll rotates. When the container arrangement is held with the outfeed opening facing downwards, the end surface of the roll will rest on the rotatable guide member and the rotational friction of the roll will naturally be low. The tensile force acting in the web will be minimized in both cases. It will be understood that with a container arrangement having a small centrally positioned web outfeed opening, the container end-wall which supports the bottom end surface of the roll may be rotatably journalled so as to further reduce web tension as the web is drawn from the container arrangement with the outfeed opening facing upwards.

According to another embodiment of the invention, and particularly according to an arrangement which is constructed to enable the arrangement to be fixedly mounted, for instance on a wall, with the outfeed opening facing downwards, the outfeed opening need not have the form of a small central hole but may, instead, have the form of an annular gap defined between the generally cylindrical outer wall of the container and the edge of the guide member.

The invention will now be described in more detail with reference to two exemplifying embodiments thereof and also with reference to the accompanying schematic drawings.

BRIEF DESCRIPTION OF THE DRAWINGS

FIG. 1 illustrates a container arrangement I which is rotationally symmetrical about an axis 10. The arrangement 1 includes a bottom plate 2 which supports a base plate 21 through the medium of a rotational bearing means 22. The base plate carries a central pin 23 whose effective height exceeds the height or axial extension of a toilet paper roll 3, the pin 23 extending through the centre bore of said roll. Located at the upper end of the pin 23 is a disc-shaped guide member 4, which is coaxial with the pin 23 and the bottom plate 2 and is journalled on a journal bearing 5. In the illustrated case, the bearing 5 has the form of a peg 51 which is removably received in a corresponding recess 24 in the upper part of the pin 23 with a friction fit.

Figure 1:
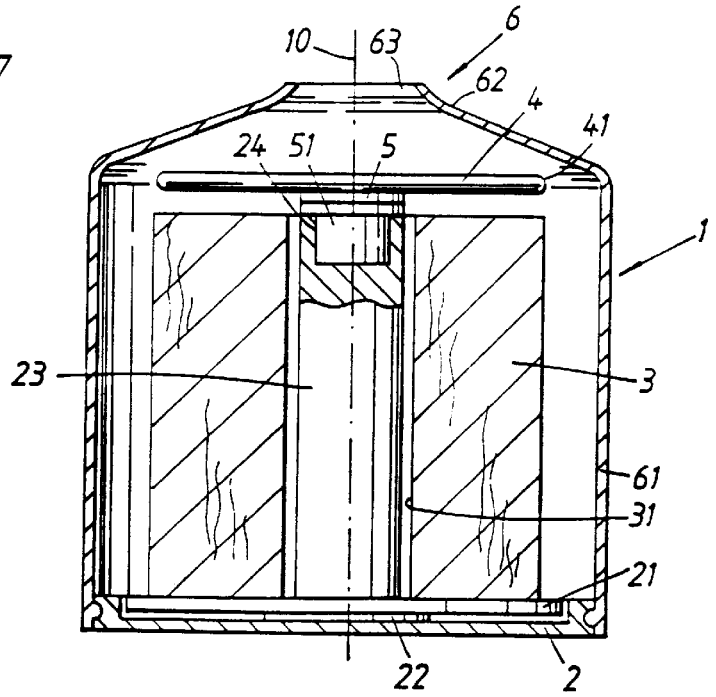
FIG. 1 is an axial sectional view of a first embodiment of an inventive arrangement.

The arrangement also includes a generally basin-shaped container part 6 having a cylindrical outer wall 61 whose free edge is removably connected to the bottom plate 2, for instance by means of a snap-fastener. The container part 6 includes a bottom part 62 which merges with the outer container wall 61 and which includes a central, circular opening 63 whose diameter corresponds essentially to the diameter of the centre bore 31 of the roll. The guiding peripheral edge 41 of the guide member 4 is spaced axially from the adjacent end surface of the roll 3. This spacing may be 1 cm, for instance. The distance between the container part 62 and the guide member 4 is also from one to two centimeters.

The illustrated container part 62 is gently curved in a direction towards the opening 63, so as to minimize the friction that acts on a web as it is unwound from the outside of the roll 3 and guided past the edge 41 of the guide member 4 and out through the opening 63.

The roll 3 will normally have a central, inner winding core made of cardboard or like material, this core being relatively smooth and only generating slight friction against the pin 23, so as to allow the roll 3 to rotate smoothly on said pin. By constructing the roll support seating in the form of two separate plates 2, 21 with an intermediate rotary journal bearing 22, however, there is no need to rely upon smooth and easy rotation of the roll 3 on the pin 23.

However, in the case of toilet paper rolls 3 having a central cardboard winding core it has been found that the roll 3 will rotate relatively smoothly on the base plate 21 and around the pin 23, and consequently the base plate 21 may conveniently be made a fixed part of the bottom plate 2. In the case of the illustrated embodiment of the container arrangement at present preferred, the guide member 4 has a smooth peripheral edge 41 and is journalled for rotation on the pin 23, which is fixedly connected to the bottom plate 2. This embodiment has been found to have good operational properties. However, it is possible to refrain from the use of a rotational bearing 5 and, in principle, to mount the disc 4 immovable in relation to the bottom plate/base plate.

Figure 2:
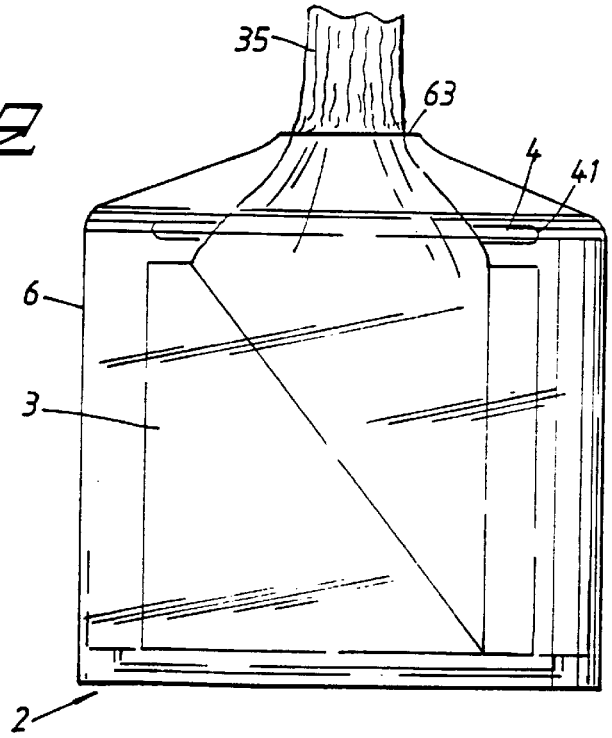
FIG. 2 is a side view of the arrangement according to FIG. 1, which includes a transparent container casing.

As indicated in FIG. 2, the web taken from the roll 3 is deflected from the circumferential direction of the roll to a direction which diverges slightly from the axial direction and past the edge of the guide member 4, whereafter the web is moved in a direction which converges onto the axis 10 and past the edge of the opening 63, where the web is drawn generally in the axial direction 10 by the user.

In the case of the illustrated embodiment of the inventive container arrangement, all parts of the arrangement are rotational-symmetrical in relation to a common symmetry axis 10.

It will be observed that, among other things, the guide member functions to prevent the web drawn from the roll being pressed so heavily against the edge of the roll as to retard the web to an extent which will cause the web to tear-off inside the container arrangement.

In the case of those embodiments of the invention in which the roll has a radial clearance in relation to the pin 23 and has a corresponding radial mobility on the pin 23, it is not necessary for the outer diameter of the guide member (which can be assumed to be mounted on one attachment point in the arrangement) to be at least generally of the same size as the initial outer diameter of the roll. This is because when the web exerts a radially inward force against the roll as the web is drawn therefrom, she roll will be moved radially in the direction afforded by said clearance.

It will also be observed that the roll itself may be soft and pliable, wherefore the force exerted by the web on the roll as the web is drawn therefrom (and therewith the retarding force) will be small and possibly acceptable, even when the withdrawn web also deforms the edge region of the roll locally. As will be understood, the retarding or braking problem is only relevant when the roll is essentially new, i.e. before the diameter of the roll has been reduced to any great extent.

The effective diameter of the guide member shall therefore be seen in the light of the afore-discussed possible conditions under which the inventive arrangement shall operate, wherein the outer rim of the guide member functions to deflect the withdrawn web in the section between the outfeed opening and the outer cylindrical surface of the roll such as to reduce braking friction between the roll and the web extending therefrom to an extent at which the risk of tearing the web is acceptably low.

The edge defining the outfeed opening may conveniently be configured so as to retard the web when the web deviates markedly from the axial direction, so that the web can be torn outside the opening when drawn from the roll.

Figure 3:
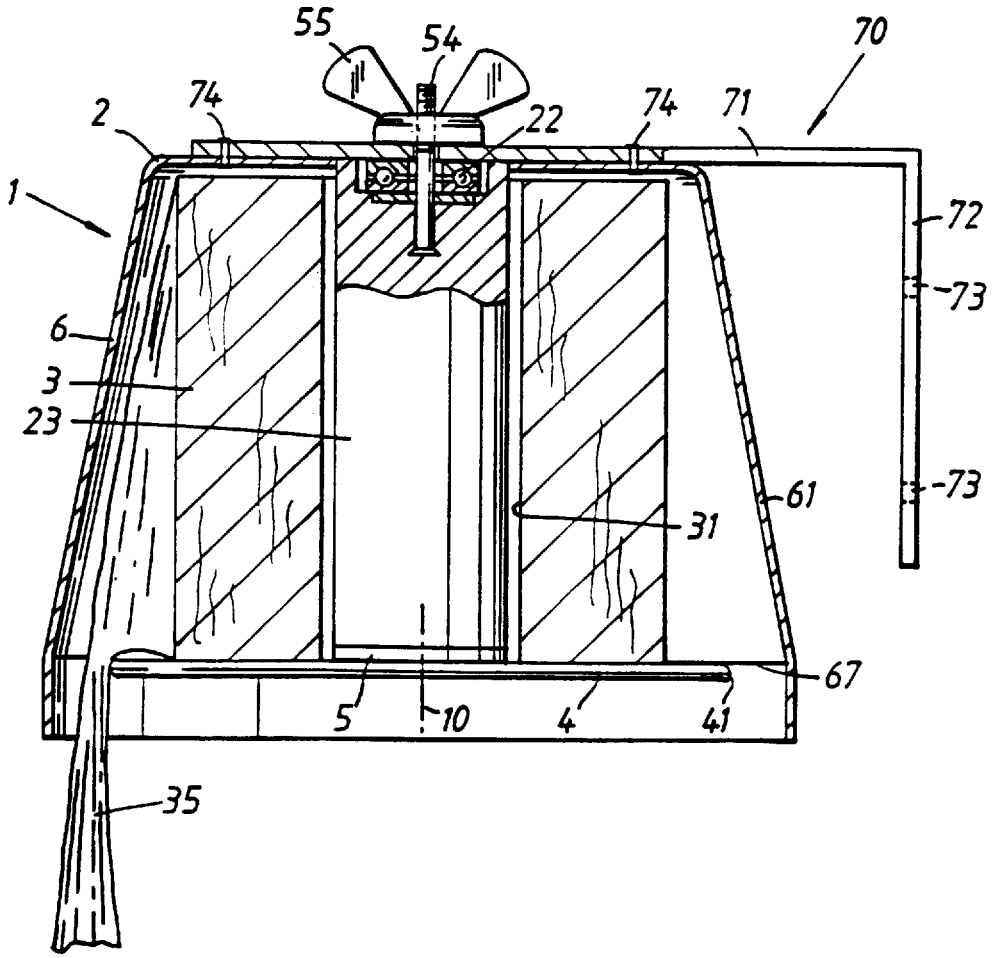
FIG. 3 is a schematic axial sectioned view of a second embodiment of an inventive arrangement.

The embodiment illustrated in FIG. 3 corresponds to the embodiment illustrated in FIGS. 1 and 2, but with the exception that the opening through which the paper web 35 is drawn from the container arrangement has the form of an annular gap 67 between the peripheral edge 41 of the disc-shaped guide member 4 and the generally cylindrical outer surface 61 of the container. Thus, the FIG. 3 embodiment does not include a container wall part 62 which narrows towards a central outfeed hole whose diameter is considerably smaller than the diameter of the guide member 4. As. will be seen from FIG. 3, similar to the aforedescribed embodiment, this embodiment includes a rotatably mounted guide disc 4 whose diameter is greater than the maximum diameter of the roll 3. Similar to the embodiment illustrated in FIGS. 1 and 2, the rotatably mounted guide member 4 of the FIG. 3 embodiment is located at that end of the container arrangement which includes the outfeed opening 63/67.

As will be seen from the FIG. 2 illustration, when the arrangement is orientated in the shown position, a pulling force on the web 35 will cause the roll 3 to be lifted upwards and therewith reduce the force with which the roll normally lies against the roll support or seating 2, so that the roll is able to rotate more easily. When the position of the arrangement is reversed, i.e. when the web outfeed opening faces downwards (c.f. FIG. 3), the roll 3 will rest on the rotatably journalled disc-shaped guide member 4, thereby enabling the roll 3 to rotate when the web 3 is subjected to an axial pulling force, even when the roll is firmly in abutment with the guide member 4 as a result of the increase in normal force between the roll 3 and the member 4.

As will be seen from FIG. 3, the gap 67 is dimensioned so that the web 35 will not fall back into the container interior when the container is positioned with the guide member 4 facing upwards.

The disc-shaped guide member 4 of the FIG. 3 embodiment can be journalled for rotation, by fixedly connecting the member 4 to the pin 23 and connecting the end of the pin to the opposite end wall of the container 1 through the medium of a rotational bearing means 22, for instance through the medium of a thrust bearing. The connection between the upper end of the pin 23 and the container end plate 2 may have the form of a screw joint which extends through the thrust bearing 22 and which engages on its upper side with a releasable joint element, such as a wing nut 55 which coacts with a joint element 54, such as a central screw 54 fixedly connected to the pin 23.

The FIG. 3 embodiment can also be constructed so as to enable the arrangement to be fitted firmly on a wall structure, in which case the arrangement will also include an angled mount 70. One leg 71 of the mount 70 is riveted (74) to the container wall 2 and the other leg 72, which extends at right angles to the leg 71, is provided with screw holes 73, wherein the leg 72 is conveniently adapted to lie against a wall and to extend vertically so as to expose the gap 67 downwardly.

As will be understood, instead of providing a rotational bearing means 22 at the top of the arrangement, a rotational bearing means 5 may be provided between the guide member 4 and the pin 23, as illustrated in the bottom part of FIG. 3, although it must be possible to open the container arrangement under all circumstances in order to enable new rolls 3 to be fitted therein.

According to one variant of the FIG. 3 embodiment, the angled mount 70 may be used as a container arrangement handle and the removable connection 54, 55 may be located between the guide member 4 and the pin 23, wherein the rotational bearing means of the guide member 4 may either have the form of the bearing 22 shown in FIG. 3 or the form of the bearing 5, also shown in said Figure. The advantage with having the bearing 22 on the end of the pin 23 distal from the guide member 4 is that the roll 3 need not then rotate in relation to the pin 23.

The FIG. 3 embodiment may be understood as being based on the embodiment shown in FIG. 1, but with the end wall 62 having the central hole 10 being omitted and the web outfeed opening being defined by the edge of the cylindrical wall 61 and the adjacent peripheral edge 41 of the disc-shaped guide member 4.

We claim:

1. A container arrangement which is constructed to enable a web to be drawn from an outer surface of a generally cylindrical roll, wherein the arrangement includes an openable container in which the roll can be rotatably fitted, wherein the container has a web outfeed opening which is generally coaxial with the axis of the roll, wherein the container includes a circular guide member which is positioned between the container outfeed opening and an adjacent end surface of the roll, wherein the circular peripheral edge of said guide member is generally coaxial with the axis of the outfeed opening, and wherein said guide member has a diameter large enough to keep the web out of general web-retarding contact with the edge of the roll, characterized in that the guide member is journalled for rotation in the container about an axis which is generally coaxial with the roll axis.

2. An arrangement according to claim 1, characterized in that the container includes a pin, which is centrally disposed and which is connected at one end to a base plate and which carries the guide member at its other end, wherein the pin is intended to extend through the central bore of the hollow cylindrical paper roll.

3. An arrangement according to claim 2, characterized in that the guide member is removably mounted on the pin.

4. An arrangement according to claim 1, characterized in that the circular guide member has a radius which is at least as large as a radius of the roll as seen from the axis of the guide member.

5. An arrangement according to claim 1, characterized in that the diameter of the guide member is at least approximately equal to the original, full diameter of the roll when the roll is coaxial with the guide member.

6. An arrangement according to claim 1, characterized in that the roll is mounted so as to be displaceable radially in relation to the axis of the guide member.

7. An arrangement according to claim 1, characterized in that the guide member is mounted so that its peripheral edge is spaced axially from the adjacent end surface of the roll through a distance when an opposite end surface of the roll rests on a roll seating arrangement.

8. An arrangement according to claim 1, characterized by a paper roll seating and a supportive surface, wherein said seating is mounted on a rotational bearing means for rotation about the axis of the guide member, and wherein said seating preferably includes a central pin and a bottom plate.

9. An arrangement according to claim 1, characterized in that the arrangement further includes a generally funnel-shaped container part having a bottom wall in which the web outfeed opening is disposed; and in that the opening is a central, circular opening whose diameter is smaller than the initial outer diameter of the roll.

10. An arrangement according to claim 9, characterized in that the diameter of said outfeed opening is significantly smaller than the initial outer diameter of an unused paper roll and is approximately the same size as the diameter of the roll centre bore.

11. An arrangement according to claim 1, characterized in that the container has a basin-like configuration; in that the arrangement also includes a wall mounting attachment with the web outfeed opening facing downwards; wherein one end surface of the roll rests on the guide member; and in that the peripheral edge of the guide member and a cylindrical container wall define therebetween a downwardly facing, essentially annular opening through which the web can be drawn out.

12. An arrangement according to claim 1, characterized in that a guide member rotation bearing is disposed between the guide member and a supportive element.

13. An arrangement according to claim 1, characterized in that the guide member journal bearing is positioned at an end region of a guide member supporting element that projects out from the roll.

14. An arrangement according to claim 1, characterized by means for detachably fitting the guide member in said arrangement to enable roll replacement.

15. An arrangement according to claim 1, characterized by means for removing and installing the guide member supporting element to enable roll replacement.

16. A container arrangement for drawing a web from an outer surface of a generally cylindrical roll, the container comprising:

a web outfeed opening;

a continuous elongated pin having a first end and a second end;

a circular guide member rotatably connected to the first end of said elongated pin; and, a base plate rotatably mounted in said container, the base plate connected to the second end of said elongated pin.

17. The container of claim 16, wherein said guide member has a peg and the first end of said pin has a recess for rotatably receiving the peg.

18. The container of claim 16, wherein said guide member is further removably connected to the first end of said elongated pin.

19. The container of claim 16, wherein the guide member has a radius that is at least as large as a radius of the roll.

20. The container of claim 16, wherein an end of the container at which the web outfeed opening is located is funnel-shaped.

* * * * *